US008311232B2

(12) United States Patent
Olive

(10) Patent No.: US 8,311,232 B2
(45) Date of Patent: Nov. 13, 2012

(54) METHOD FOR PREDICTING LOUDSPEAKER PREFERENCE

(75) Inventor: Sean Olive, Valley Village, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1800 days.

(21) Appl. No.: 11/071,371

(22) Filed: Mar. 2, 2005

(65) Prior Publication Data

US 2005/0195982 A1 Sep. 8, 2005

Related U.S. Application Data

(60) Provisional application No. 60/549,731, filed on Mar. 2, 2004, provisional application No. 60/603,319, filed on Aug. 8, 2004, provisional application No. 60/622,372, filed on Oct. 28, 2004.

(51) Int. Cl.
*H04R 29/00* (2006.01)

(52) U.S. Cl. ..... 381/59; 381/56; 381/103; 381/58

(58) Field of Classification Search ..... 381/56, 381/58–59, 96, 61, 103; 29/594
See application file for complete search history.

(56) References Cited

U.S. PATENT DOCUMENTS

| | | | | |
|---|---|---|---|---|
| 5,745,586 | A * | 4/1998 | Tagami et al. | 381/103 |
| 6,327,366 | B1 * | 12/2001 | Uvacek et al. | 381/60 |
| 6,731,760 | B2 * | 5/2004 | Pedersen | 381/59 |
| 7,373,209 | B2 * | 5/2008 | Tagawa et al. | 700/94 |
| 7,526,093 | B2 * | 4/2009 | Devantier et al. | 381/59 |
| 2001/0028716 | A1 * | 10/2001 | Hill et al. | 381/58 |

* cited by examiner

*Primary Examiner* — Disler Paul
(74) *Attorney, Agent, or Firm* — The Eclipse Group LLP

(57) ABSTRACT

A general model is provided for predicting a loudspeaker preference rating, where the model's predicted loudspeaker preference rating is calculated based upon the sum of a plurality of weighted independent variables that statistically quantify amplitude deviations in a loudspeaker frequency response. The independent variables selected may be independent variables determined as maximizing the ability of a loudspeaker preference variable to predict a loudspeaker preference rating. A multiple regression analysis is performed to determine respective weights for the selected independent variables. The weighted independent variables are arranged into a linear relationship on which the loudspeaker preference variable depends.

20 Claims, 6 Drawing Sheets

METHOD FOR PREDICTING LOUDSPEAKER PREFERENCE

RELATED APPLICATIONS

This application claims priority to U.S. Provisional Patent Application Ser. No. 60/549,731 filed on Mar. 2, 2004, titled A Multiple Regression Model for Predicting Loudspeaker Preference Using Objective Measurements: Part I-Listening Test Results; and U.S. Provisional Patent Application Ser. No. 60/603,319 filed on Aug. 8, 2004, titled A Multiple Regression Model for Predicting Loudspeaker Preference Using Objective Measurements: Part II—Development of the Model; and U.S. Provisional Patent Application Ser. No. 60/622,372 filed on Oct. 28, 2004, all of which are incorporated into this application by reference in their entirety.

BACKGROUND OF THE INVENTION

1. Field of the Invention

This invention relates generally to loudspeakers. More particularly, the invention relates to providing a model for predicting loudspeaker preferences by listeners based on multiple regression analysis utilizing objective measurements.

2. Related Art

Properly controlled listening tests on loudspeakers are difficult, time-consuming and expensive to perform. A more cost-effective solution is to utilize a model that accurately predicts listeners' subjective sound quality ratings based on objective measurements made on the loudspeaker. A few models have been proposed. In assessing such models, however, it becomes clear that there is little agreement about how the loudspeakers should be measured and in what types of environments they should be measured. Choices range from reverberation chambers, listening rooms, anechoic chambers, or a combination of these environments. Low-resolution, ⅓-octave, steady-state measurements appear to be popular choices even though they cannot accurately distinguish medium-high Q resonances from low-Q ones, the later being much more audible at low amplitudes. Opinions diverge widely about the relative importance of the direct, early-reflected and reverberant sounds produced by the loudspeaker in terms of their contribution to its perceived timbre and spatial attributes. These differences in opinion tend to dictate the choices of rooms and measurements employed by the models to predict loudspeaker sound quality. Most of the models have not been adequately tested or validated, which calls into question their accuracy and generalizability. Generalizability describes how well the model predicts sound quality when applied to a large population of loudspeakers and rooms.

Several sophisticated, perceptual-based objective measurements have been recently standardized for predicting the subjective quality of low-bit rate audio codecs. However, such models are optimized for characterizing forms of non-linear distortions common to audio codecs rather than loudspeakers. Moreover, none of the current codec measurement models include the psychoacoustic effects related to the loudspeaker's complex frequency-dependent radiation properties and its interaction with the room. As these effects can significantly affect the properties of sound at the listeners' ears, they typically should be included in any model employed to predict loudspeaker sound quality.

Current predictive loudspeaker models may be categorized according to how they view the relative influence of the direct, early-reflected and reverberant sounds on listeners' overall impression of a loudspeaker. For instance, three quite different approaches have been taken in how and where the loudspeaker should be measured. One approach is to predict the sound quality utilizing sound power measurements, with the underlying assumption being that the total radiated sound power largely determines the loudspeaker's perceived quality in a room. A second approach is to model the loudspeaker's sound quality utilizing in-room loudspeaker measurements. A third approach is to predict the loudspeaker's sound quality utilizing a comprehensive set of anechoic measurements. In addition, one model utilizes a hybrid approach that combines the free-field on-axis response with an in-room or predicted in-room response.

Advocates of models based on sound power measurements believe that the loudspeaker's sound power response best characterizes what listeners hear in a listening room. One of the earliest sound power advocates was Rosenberg at the Swedish Consumer Testing organization in 1973. He reported good correlation between ⅓-octave speaker measurements performed in a reverberation chamber and listening tests performed by Gabrielsonn and him. However, Rosenberg never specified an exact model to predict his data. Around the same time, another sound power advocate, Staffeldt, argued that the steady-state ⅓-octave response of the loudspeaker better correlated with listening tests if the speaker was measured in-room at the listener location. Later in 1982, Staffeldt argued that the measurement should take into account the directional properties of the ears, since he noted that the diffuse field sensitivity of the ear is higher at higher frequencies than in the direct sound field. He claimed that the timbre of two loudspeakers in two different rooms would be identical, so long as they had identical ⅓-octave spectra measured at the entrance to the ear canal. Unfortunately, Staffeldt's listening tests were based on only one listener and the room was rather large and reverberant. Staffeldt put rather large tolerances on the rooms for which the results apply (up to 1000 $m^3$ with reverberation times less than 1 second). Staffeldt later proposed a model for predicting the timbre of a loudspeaker based on calculating the specific loudness of the ⅓-octave data.

The flat sound power criterion had a large contingent of support in the United States. In 1968, Bose argued that when a loudspeaker is properly placed with respect to the rear reflecting wall, the frequency response measured with respect to the total radiated acoustical energy should be flat. Other supporters of this view included Consumers Union ("CU") in 1973.

During that period, CU developed an objective-based model based on the loudspeaker's calculated sound power response measured at ⅓-octave resolution in an anechoic chamber. The rationale for this was based on CU's belief that the loudspeaker's total power response predicts to a large degree the sound pressure response taken over several seats in a typical home listening room, and that flat sound power response is the best target. CU does several transformations to the raw sound power response to account for low frequency changes due room boundary effects and wall absorption. The raw sound power response is also adjusted in ⅓-octave bands according to loudness using Steven's Mark VII scheme. As the speaker deviates from equal loudness over a certain bandwidth the error is subtracted from its overall 100-point score. There are many theoretical arguments as to why the CU model might not work, including the accuracy of the loudness model used or even the appropriateness of applying such a model. However, the ultimate test is how accurately the model predicts listeners' sound quality ratings. Tests have established that no correlation is found to exist between listeners' loudspeaker preference ratings and CU's predicted accuracy scores ($r=0.05$; $p=0.81$). Thus, because the CU model is based largely on a loudspeaker's ⅓-octave sound power response, measured sound power alone does not accurately predict the perceived sound quality of the loudspeaker.

In 1990, Klippel reported a perceptual-based loudspeaker model for predicting various sound quality dimensions and overall sound quality. The model was based on a massive study involving seven different experiments designed to examine the influence of factors on loudspeaker quality such as listener experience, room acoustics, speaker directivity, program material and method of scaling (semantic differential versus MDS). A total of forty-five different loudspeakers (both real and simulated), three different rooms, thirteen programs and forty different listeners were compared. The rooms included an anechoic chamber, an IEC listening room and a small studio. Factorial analysis revealed seven unique dimensions such as clearness, treble stressing (sharpness), general and low bass emphasis, feeling of space, clearness in bass and brightness.

The subjective magnitude of each dimension could be predicted based on a combination of the ⅓-octave steady-state in-room frequency response measured at the listening position. Klippel claimed that the model could use either in-room measurements or anechoic data containing the on-axis and the calculated sound power responses. With this data and a simple model of the room, the predicted in-room curves agreed within 2-3 dB of the measured ones above 200 Hz. Below 200 Hz, room modes caused large (5-10 dB) deviation, which Klippel believed was not a problem since the deviations would be the same for all loudspeakers. It is not known how Klippel avoided these low frequency positional-related deviations in his listening tests without substituting the positions of the speakers. The final input to the model compared the measured response to an ideal reference with flat frequency response. Superimposed on the reference was the long-term average spectrum of the program to better predict listeners' impressions.

Using a modified loudness model, Klippel calculates the difference in loudness density between the reference and measured curves across each ⅓-octave center frequency using a critical bandwidth filter. The loudness differences are further transformed and weighted for each objective metric used to predict the subjective dimensions. The correlations between objective and subjective dimensions were quite high. Klippel found, however, that the feeling of space associated with loudspeaker directivity depended on the program. More directional speakers were preferred for speech compared to music.

For predicting overall sound quality (pleasantness and naturalness), multiple objective dimensions were selected and weighted on the basis of their high correlations with the overall quality ratings. Each dimension was expressed in terms of its defect or deviation from a predetermined "ideal" value. For naturalness, the three salient weighted dimensions included discoloration defects (DV), brightness defects (DH) and defects in the feeling of space (DR). For pleasantness, Klippel found DV and DH to be the most relevant parameters. The correlations here between predicted and observed values are not as consistently high as the individual sound-related dimensions. For pleasantness, correlation varies across tests from −0.32 to 0.94. For naturalness, correlation values range from 0.52 to 0.93. The sources of these large variations in correlation are not specified. Potential factors may have been differences in the listening rooms, programs, listeners and experimental procedure. This illustrates an important feature of developing any predictive model; it can only be as reliable and accurate as the subjective data on which it is based. The weakest link tends to be the reliability of the subjective data, not the objective data. Human beings are more prone to random errors in judgment than the computers performing the objective measurements.

In 1986, Toole published the results of a two-year study where forty-two listeners evaluated thirty-seven different loudspeakers. Good visual correlations were found between a set of comprehensive anechoic measurements and the listening test results. Toole argued that ⅓-octave in-room measurements lack the necessary frequency resolution to distinguish between low and medium-high Q resonances. This feature is important since the audibility of resonances varies significantly as a function of the resonances' frequency and Q-factor. In order to assess the audibility of resonances, Toole recommended a minimum frequency resolution of 1/20-octave.

Toole introduced the technique of spatially averaging several anechoic measurements to identify and separate resonances from diffraction and acoustic interference effects, which he believed to be less audible in listening rooms. By averaging certain sets of measurements made at specific angles, he was able to calculate and predict the frequency response of the direct, early-reflected and reverberant sounds in a typical room. Utilizing similar objective measurements, recent loudspeakers studies done in different rooms have shown similarly good correlations. However, to date, none have produced a model that uses the measurements to predict listeners' preference ratings. From these studies, it is clear that no one measure of loudspeaker sound output, direct, early-reflected or sound power (reverberant) is dominant at all frequencies. The inference is that the perception of sound quality embraces a combination of them all, weighted according to the reflectivity of the listening room.

It seems most logical that the in-room measurements at the listeners' ears would provide the closest representation of what the listener perceives. However, there are several problems. Steady-state in-room measurements average all of the direct, reflected and reverberant sounds together even though there is evidence that the human auditory system is quite good at processing and analyzing these three components separately. By doing so, these measurements dismiss the complex perceptual processes that two ears and a brain are capable of performing. For example, the direct sound triggers the precedence effect (forward temporal masking), binaural discrimination, in which the direction and timing of later arrivals affect their perception and various other directional and spatial effects.

Finally, there is evidence that equalizing the loudspeaker's sound power response to be flat results in lower preference ratings if the loudspeaker does not have constant (flat) directivity and the listener is not in a reverberant room. Most consumer loudspeakers do not have constant directivity. Typically, the directivity rises with increasing frequency. Equalizing the sound power of these loudspeakers to be flat will be done at the expense of the on-axis response, which will be too bright from the resulting upward spectral tilt at higher frequencies. This can lead to lower preference ratings. Finally, typical domestic listening rooms are not reverberant. On average, they have $RT_{60}$ values of around 0.4 second.

In summary, three different approaches have been taken in measuring loudspeakers based on three different views on what factors best correlate with perceived sound quality: 1) ⅓-octave sound power measurements, 2) a perceptual model based on a combination of ⅓-octave direct and reverberant sounds, and 3) comprehensive, 1/20-octave, spatially-averaged, anechoic measurements performed at many angles. Two models have been proposed based on the flat sound power criterion while Klippel's model uses the second approach of a perceptual model based on a combination of ⅓ octave direct and reverberant sounds.

Therefore, there remains a need for providing an objective-based approach for predicting the loudspeaker preferences of listeners, which overcomes the disadvantages set forth above and others previously experienced.

SUMMARY

A general model is provided for predicting a loudspeaker preference rating. According to one example implementation, the model's predicted loudspeaker preference rating is correlated, using a statistical regression model, to a measured deviation in a frequency response of a loudspeaker measured at octaves as least as high as $1/6^{th}$ octaves.

In one example implementation, the loudspeaker preference rating is calculated based upon the sum of a plurality of weighted independent variables that statistically quantify spatially averaged amplitude deviations in the loudspeaker frequency response calculated with a smoothing filter of at least ⅙ octaves.

In one example, the loudspeaker preference rating may be calculated by obtaining a comprehensive set of frequency response curves for a set of loudspeakers calculated using an octave smoothing filter at least as high as $1/6^{th}$ octaves. Then, various statistical measures may applied to the set of frequency response curves to derive a set of independent variables. Once the independent variables are established the variables are correlated to loudspeaker preference rating by calculating a measured deviation between the statistical measures and frequency response for each independent variable. Once correlated, a set of independent variables is selected that is indicative of loudspeaker preference determined by selecting independent variables with maximum ability to predict a loudspeaker preference rating based upon correlation to loudspeaker preference. A statistical regression technique is then applied to the selected set of independent variable to determining preference rating by using a statistical regression technique to weigh the variables and arrange the weighted independent variables into a linear relationship on which the loudspeaker preference variable depends.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
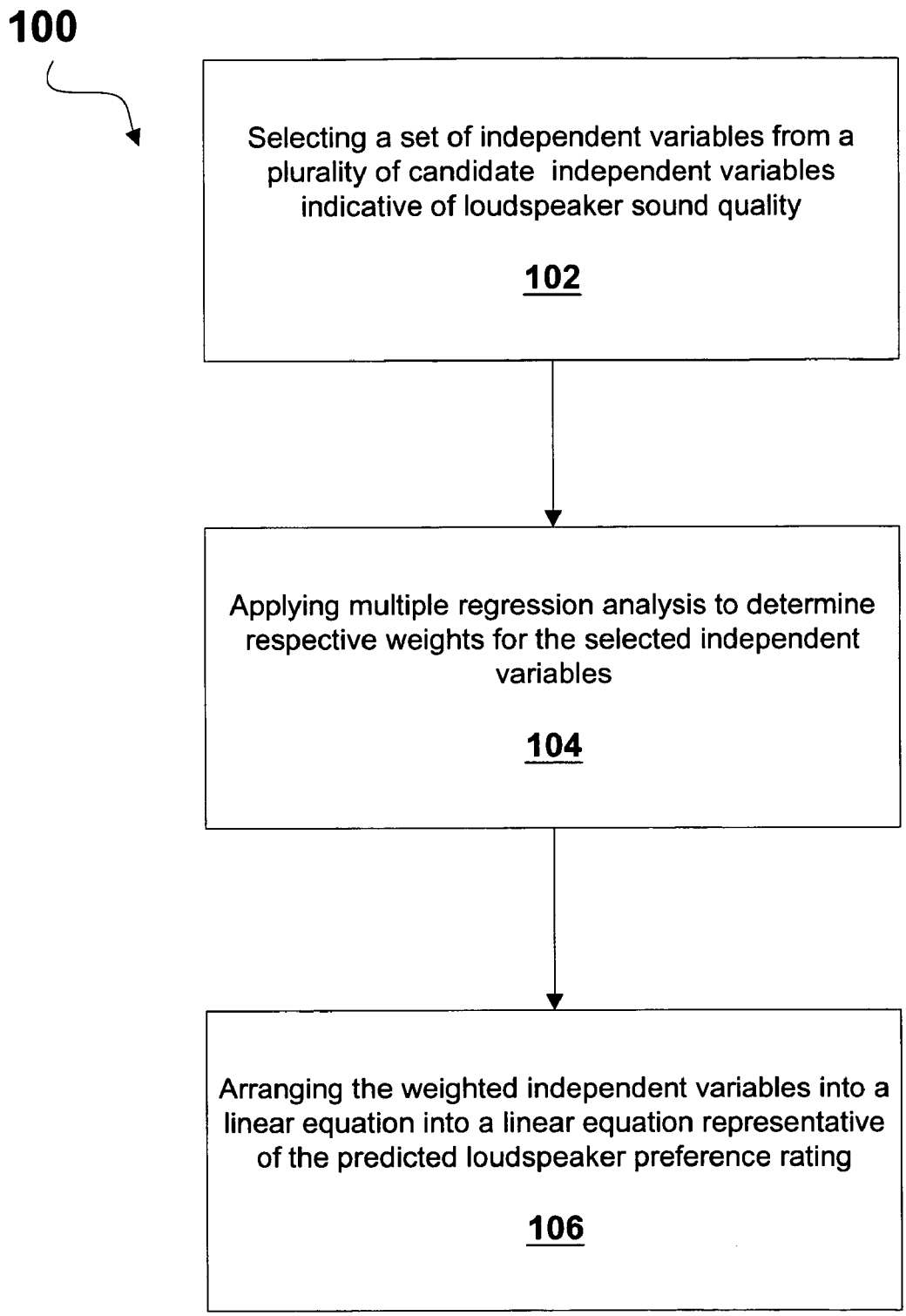
FIG. 1 is a flow diagram illustrating a method for predicting loudspeaker preference ratings based on objective measurements according to one example implementation.

A general model is provided for predicting a loudspeaker preference rating that correlates the loudspeaker's preference rating to a measured deviation in the comprehensive spatially averaged frequency response of a loudspeaker using a statistical regression model. For purposes of this application a loudspeaker preference rating means any indicator of perceived sound quality, including, but not limited to, scales of preference, fidelity, naturalness or other similar indicators.

Testing may be performed in a manner analogous to the test procedure set forth in A Multiple Regression Model for Predicting Loudspeaker Preference Using Objective Measurements: Part I-Listening Test Results contained in U.S. Provisional Patent Application No. 60/549,731 incorporated by reference into this application in its entirety. The testing may use an automated loudspeaker testing facility including a listening lab and an anechoic testing facility. The listener input may be obtained using controlled testing in the listening lab that utilizes a computer (also referred to as a "control computer") to provide audio samples to each listener from a set of two or more loudspeakers. Control equipment used in the listening lab including the switching of audio signals may be controlled through computer automation and may provide program signals from a storage medium such as a computer memory to the loudspeaker. As an example, objective data for a speaker may be obtained in an anechoic loudspeaker chamber. The testing process thus leads to a method that allows subsequent testing of loudspeakers to obtain predictions of listener preferences for the loudspeaker relative to other loudspeakers through use of a computer using a previously obtained computer model based at least in part upon earlier tests with human listeners. This method of predicting the preferences of listeners for a given tested loudspeaker may be used instead of using an engineer's interpretation of collected data.

According to one example implementation, the model's predicted loudspeaker preference rating is calculated based upon the sum of a plurality of weighted independent variables that statistically quantify amplitude deviations in a loudspeaker frequency response. To develop the model, the independent variables $X_1$-$X_n$ used in the model are weighted in accordance with their relative contribution to predicted listener's preference ratings. In one example implementation, the variables may be weighted through the application of the multiple regression model, although other statistical regression models, such principle component regression, partial least squares regressions or other similar regression models may be utilized.

Through application of multiple regression analysis, the respective weights $b_1$-$b_n$ for the selected independent variables $X_1$-$X_n$ may be determined. The weighted independent variables then are arranged into a linear relationship on which the loudspeaker preference rating depends according to:

$$Y_1=b_0+b_1X_1+b_2X_2+b_3X_3+\ldots b_nX_n,$$

where n is the number of selected independent variables, $Y_1$ is the predicted preference rating of the speaker and where the equation represents an objective model that may be used to predict the preference rating of a loudspeaker.

FIG. 1 is a flow diagram illustrating an example method 100 that may used to develop the prediction model. As illustrated in FIG. 1, the method 100 provides for the generation of a linear equation, i.e., the prediction model, that can be used to predict loudspeaker preference ratings based on objective measurements, such as anechoic measurements, in-room measurements, or other such measurements known by those skilled in the art.

In step 102 of the method 100 in FIG. 1, a set of independent variables is first selected from a plurality possible independent variables related to sound quality of a loudspeaker. The set of independent variables is selected by determining which of the possible plurality of independent variables have the least or lowest collinearity. In other words, the independent variables that maximize predictive ability of the dependent variable (i.e. loudspeaker preference rating), while at the same time ensure that the independent variables are not highly correlated with each other, are selected from the plurality of independent variables.

In step 104 of the method 100 in FIG. 1, multiple regression analysis is performed to determine respective weights for the selected independent variables. Then, in step 106, the weighted independent variables are arranged into a linear equation representative of the predicted loudspeaker preference rating.

Accordingly, once the independent variables are weighted and collected into a linear relationship, values can be set for the independent variables and the linear relationship may be solved. The result will be a value found for the loudspeaker preference variable that is representative of the predicted preference rating of a listener for a given loudspeaker. As will be discussed in further detail below, appropriate implementation of the method will yield predicted preference ratings, derived from objective measurements, that highly correlate with actual, subjectively derived preference ratings from listening tests.

A. Selection of Independent Variables

The set of independent variables, in step 102 of FIG. 1, may be selected from a plurality of candidate independent variables indicative of loudspeaker sound quality. The independent variables may be derived from one or more statistical measures. Each statistical measure may be applied to one or more different frequency response curves that are obtained by testing a sample population of different loudspeakers, thereby providing additional independent variables that may be candidates for inclusion in the predictive model.

In one example, these frequency response curves are obtained from objective measurements, such as anechoic measurements, in-room measurements, or other such measurements known by those skilled in the art, measured around the horizontal and vertical radiating orbits of population of loudspeakers in a wide-frequency band with $1/20^{th}$ octave smoothing filtered applied. Further, spatial averaging may be used for all the curves (except the on-axis curves, if provided) to remove interference and diffraction effects from the measurements. Although this example provides for the application of $1/20^{th}$ octave smoothing filters, those skilled in the art will recognize that a filter of ⅓ octave or greater may be used to smooth the curves.

To evaluate a set of independent variables for potential use in the model for predicting loudspeaker preference ratings, the predictive power of each variable is examined. In one example implementation, the predictive power of each variable may be examined by looking at its correlation with the preference ratings observed from listening tests for the same loudspeakers. In addition, the multicollinearity or correlation between the independent variables may also be examined.

1. Derivation of Independent Variables

As set forth above, one method for predicting the power of independent variables for use in creating the model equation for predicting listener preference may involve examining the amount of correlation between each independent variable with the preference ratings observed from listening tests. Thus, objective measurements representative of independent variables are compared to subjective measurements taken from listener observations. Those independent variables that are most highly correlated with the subjective listener preference ratings but uncorrelated to one another may be candidates for use in the model.

Any number of independent variables may be considered as potential candidates. These variables may be derived by applying statistical measures to a variety of frequency responses measured around the horizontal and vertical radiating orbits of a loudspeaker. More specific examples of statistical measures may include, but are not limited to, absolute average deviation (AAD), narrow band deviation (NBD), smoothness (SM), slope (SL), low frequency extension (LFX), and low frequency quality (LFQ). Examples of frequency response curves may include, but are not limited to, on-axis response (ON), listening window (LW), early-reflections (ER), predicted in-room response (PIR), sound power (SP), early-reflections directivity index (ERDI), and sound power directivity index (SPDI). Spatial averaging may be used for all curves (except the on-axis (ON) response curve) to remove interference and diffraction effects from the measurements.

By way of example, in one example embodiment, thirty (30) independent variables may be considered as potential candidates. These independent variables may be derived from applying the following statistical measures:

(1) absolute average deviation (AAD);
(2) narrow band deviation (NBD);
(3) smoothness (SM);
(4) slope (SL);
(5) low frequency extension (LFX); and
(6) low frequency quality (LFQ))

to the following frequency response curves:

(1) on-axis response (ON);
(2) listening window (LW);
(3) early-reflections (ER);
(4) predicted in-room response (PIR);
(5) sound power (SP);
(6) early-reflections directivity index (ERDI); and
(7) sound power directivity index (SPDI).

The table below describes the six statistical measures and the loudspeaker frequency responses to which they are applied to determine the thirty independent variables.

| Statistic | Description | Measurement Applied to: |
|---|---|---|
| AAD | Absolute Average Deviation (dB) relative to mean level between 200-400 Hz | ON, LW, ER, PIR, SP, ERDI, SPDI |
| NBD | Average Narrow Band Deviation (dB) in each ½-octave band from 100 Hz-12 kHz | ON, LW, ER, PIR, SP, ERDI, SPDI |

-continued

| Statistic | Description | Measurement Applied to: |
|---|---|---|
| SM | Smoothness ($r^2$) in amplitude response based on a linear regression line through 100 Hz-16 kHz | ON, LW, ER, PIR, SP, ERDI, SPDI |
| SL | Slope of Best Fit linear regression line above (dB) | ON, LW, ER, PIR, SP, ERDI, SPDI |
| LFX | Low frequency extension (Hz) based on −6 dB frequency point transformed to $\log_{10}$ | SP relative to mean sensitivity in LW From 300 Hz-10 kHz |
| LFQ | Absolute average deviation (dB) in bass response from LFX to 300 Hz. | SP relative to mean sensitivity in LW |

The above statistic measures and frequency response curves are only representative of a select number of statistic and measured frequency response. One skilled in the art will recognize that independent variables for use in the described method for calculating loudspeaker preference rating may be derived by applying statistically measures, other than those set forth above, to measured frequency responses other than those set forth above.

Figure 2:
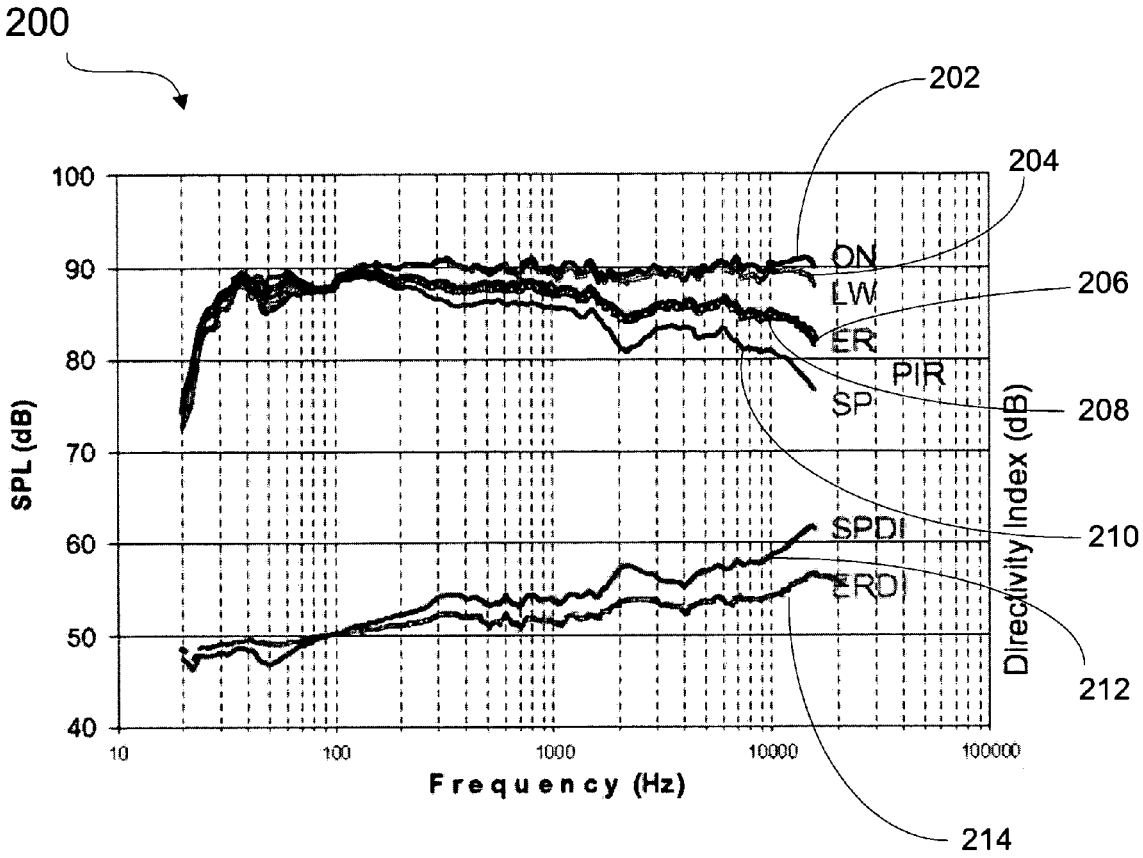
FIG. 2 illustrates seven frequency response curves utilized in developing a model predictive of listeners' loudspeaker preferences.

FIG. 2 is a graph 200 illustrating seven different frequency response curves for which the statistical measures may be applied. Line 202 represents the on-axis response (ON), line 204 represents the listening window (LW); line 206 represents the early reflection curve (ER), line 208 represents the predicted in-room response (PIR), line 210 represents the sound power (SP) and lines 212 and 214, respectively, represent the directivity indices (SPDI and ERDI) related to the sound power and early reflections.

To obtain the data in the graph 200, each loudspeaker was measured in a large anechoic chamber at a distance of two meters utilizing a maximum length sequence (MLS) test signal. The sequence and FFT size were chosen to provide 2 Hz frequency resolution across the audio band. The chamber is anechoic down to approximately 60 Hz and is calibrated down to 20 Hz. For each loudspeaker, the set of curves represent (from top to bottom) the on-axis response, the spatially averaged (±30° horizontal, ±10° vertical) listening window, the average early-reflected sounds, predicted in-room response and the calculated sound power response. The lower two curves represent the directivity indices for the early reflected sound and the total radiated sound power. While the data in this example is taken from the loudspeakers measured in a large anechoic chamber, those skilled in the art will recognize that the model may also be derived by taking in-room measurements at both 1/20 and 1/3 octaves smoothed, as well as other known objective measurement standards.

The first statistic examined for the model is the absolute average deviation (AAD), expressed in dB as defined in Equation 3:

$$AAD\ (\text{dB}) = \left( \sum_{Band=16\,kHz}^{Band=100\,Hz} |(y_{REF\ @\ 200-400\,Hz} - y_{band\ n})| \right) \div N \tag{3}$$

where the average absolute deviation in band n is calculated from the reference level $y_{REF}$ based on the mean amplitude between 200-400 Hz. The deviation is calculated in each 1/20-octave band over N bands from 100 Hz-16 kHz. Higher values of AAD indicate larger deviations in amplitude from the reference band employed. Therefore, the variable should be negatively correlated with preference.

The narrow band deviation is defined by Equation 4:

$$NBD\ (\text{dB}) = \left( \sum_{Band=12\,kHz}^{Band=100\,Hz} \left| \bar{y}_{(\frac{1}{2}\,Octave\ Band\ n)} - y_b \right| \right) \div N \tag{4}$$

where $$\bar{y}_{(\frac{1}{2}\,Octave\ Band\ n)}$$

is the average amplitude value within the 1/2-octave band n, $y_b$ is the amplitude value of band b within the 1/2-octave band n, and N is the total number of 1/2-octave bands between 100 Hz-12 kHz. The mean absolute deviation within each 1/2-octave band is based a sample of ten equally log-spaced data points. While AAD measures deviations from flatness relative to the average level of the reference band 200-400 Hz, NBD measures deviations within a relatively narrow 1/2-octave band. Thus, NBD might be a better metric for detecting medium and low Q resonances in the loudspeaker.

For each of the seven frequency response curves, the overall smoothness (SM) and slope (SL) of the curve may be determined by estimating the line that best fits the frequency curve over the range of 100 Hz-16 kHz. This may be done using a regression based on least square error. SM is the Pearson correlation coefficient of determination ($r^2$) that describes the goodness of fit of the regression line defined by Equation 5:

$$SM = \left( \frac{n(\sum XY) - (\sum X)(\sum Y)}{\sqrt{(n\sum X^2 - (\sum X)^2)(n\sum Y^2 - (\sum Y)^2)}} \right)^2 \tag{5}$$

where n is the number of data points used to estimate the regression curve and X and Y represent the measured versus estimated amplitude values of the regression line. A natural log transformation is applied to the measured frequency values (Hz) so that they are linearly spaced (see equation 6 below). Smoothness (SM) values can range from 0 to 1, with larger values representing smoother frequency response curves. Therefore, SM is the only predictor variable that should produce positive correlations with preference.

Slope (SL), which is defined as b in equation 6 below, mathematically defines the regression line that best fits to the measured frequency curve. Equation 6 is defined as:

$$\hat{Y}_i = b(\ln(x_i)) + a \tag{6}$$

where $\hat{Y}$ is the predicted value (amplitude) of the regression line at a given frequency $x_i$, b is the slope, and a is the y-intercept.

The raw slope value can have either negative values (tilting downwards) or positive values (tilting upwards). Slope (SL) is defined as the absolute difference between target slope, $b_{Target}$ versus the measured slope, $b_{measured}$ as described in equation 7:

$$SL = |b_{Target} - b_{measured}| \tag{7}$$

The target values are based on the mean slope values of speakers that fall into the top 90 percentile based on subjective preference ratings. Target slopes are defined for each of the seven frequency curves. The ideal target slope for the on-axis and listening window curves should be flat, while the off-axis curves should tilt gently downwards. The degree of tilt varies depending upon the type of loudspeakers being tested. For example, 3-way and 4-way loudspeaker designs tend to have wider dispersion (hence smaller negative target slopes) at mid and high frequencies than 2-way loudspeakers. This suggests that the ideal target slope may depend on the loudspeaker's directivity.

Target slopes for each frequency curve based on sample tests can be found below.

| Measured Curve | Target Slope Value: Test One | Target Slope Value: All Tests (70 loudspeakers) |
|---|---|---|
| ON | 0.0 | 0.0 |
| LW | −0.2 | −0.2 |
| ER | −1.2 | −1.0 |
| PIR | −2.1 | −1.75 |
| SP | −1.2 | −1.0 |
| ERDI | 1.0 | 0.8 |
| SPDI | 2.0 | 1.4 |

The low frequency extension (LFX) and quality (LFQ) of the loudspeaker are the final two variables. LFX is defined by Equation 8:

$$\mathrm{LFX}=\log_{10}(x_{SP\text{-}6dB}re:\bar{y}_LW(300\ Hz\text{-}10\ kHz)) \tag{8}$$

where LFX is the $\log_{10}$ of the first frequency $x_{SP}$ below 300 Hz in the sound power curve, that is −6 dB relative to the mean level y_LW measured in listening window (LW) between 300 Hz-10 kHz. LFX is log-transformed to produce a linear relationship between the variable LFX and preference rating. The sound power curve (SP) may be used for the calculation because it better defines the true bass output of the loudspeaker, particularly speakers that have rear-firing ports.

Low frequency quality (LFQ) is defined by Equation 9:

$$LFQ\ (\mathrm{dB}) = \left(\sum_{\mathrm{Band_SP}=300\,\mathrm{Hz}}^{\mathrm{Band_SP}=LFX} |(\mathrm{y_LW} - \mathrm{y_n})|\right) \div N \tag{9}$$

where the y is the level within each n band of the sound power curve calculated across N bands, from the lowest frequency defined by LFX up to 300 Hz.

LFQ is intended to quantify deviations in amplitude response over the bass region between the low frequency cut-off and 300 Hz. Speakers with good low bass extension may well have high deviations in amplitude response due to under/over damped alignments or incorrectly set subwoofer levels. The popular use of multiple woofers wired in parallel increases, the directivity rapidly above 100 Hz, which also causes amplitude deviations in the sound power response.

2. Correlation of Independent Variables with Preference Ratings

To determine the correlation of independent variables with preference rating, the objective data on which the values for the independent variables are derived is compared with subjective data generated from subjective listening tests. This subjective data may be generated by conducting one or more listening tests on one or more sample populations of loudspeakers. Previously conducted listening tests may serve as a suitable source of data for implementing the method for predicting the preference rating for one or more loudspeakers under inquiry. That is, once a suitable listening test has been done, there may not be a need to undertake the expense of conducting additional listening tests in the future because the predictive method may be sufficiently generalized.

According to an example implementation, a method for predicting loudspeaker preference ratings may be based on data from the testing of any number of loudspeakers. However, a more generalized model may be developed from the comparison of the independent variables with listener data derived from a larger loudspeaker sample. If too small of a number of loudspeaker samples is used, the model may be too tightly fitted to the small sample. For example, a small loudspeaker sample of thirteen loudspeakers may produce a very accurate model for the small sample, yet be too tightly fitted for application to a larger number of samples. In contrast, using a larger number of loudspeaker samples, such as seventy loudspeakers, may provide a more generalized model.

To obtain subjective data related to a sample of loudspeakers, listening tests must be performed in a listening room to develop the model. The acoustic properties of the listening room should be similar to those of professional and domestic listening rooms meeting the current industry requirements, such as ITU-R BS 1116 having a reverberation time that falls closely to ($RT_{60}$=0.4 s). The speakers should be rated according to preference, spectral balance, and distortion.

2. Comparison of Subject vs. Objective Data

The subjective measurements are then compared with the objective measurements taken on each loudspeaker, including comprehensive anechoic frequency response measurements and distortion measurements. The relationship and correlation between the objective and subjective measurements were then examined to determine which independent variables, i.e., objective measurements, exhibit the most collinearity.

Figure 3:
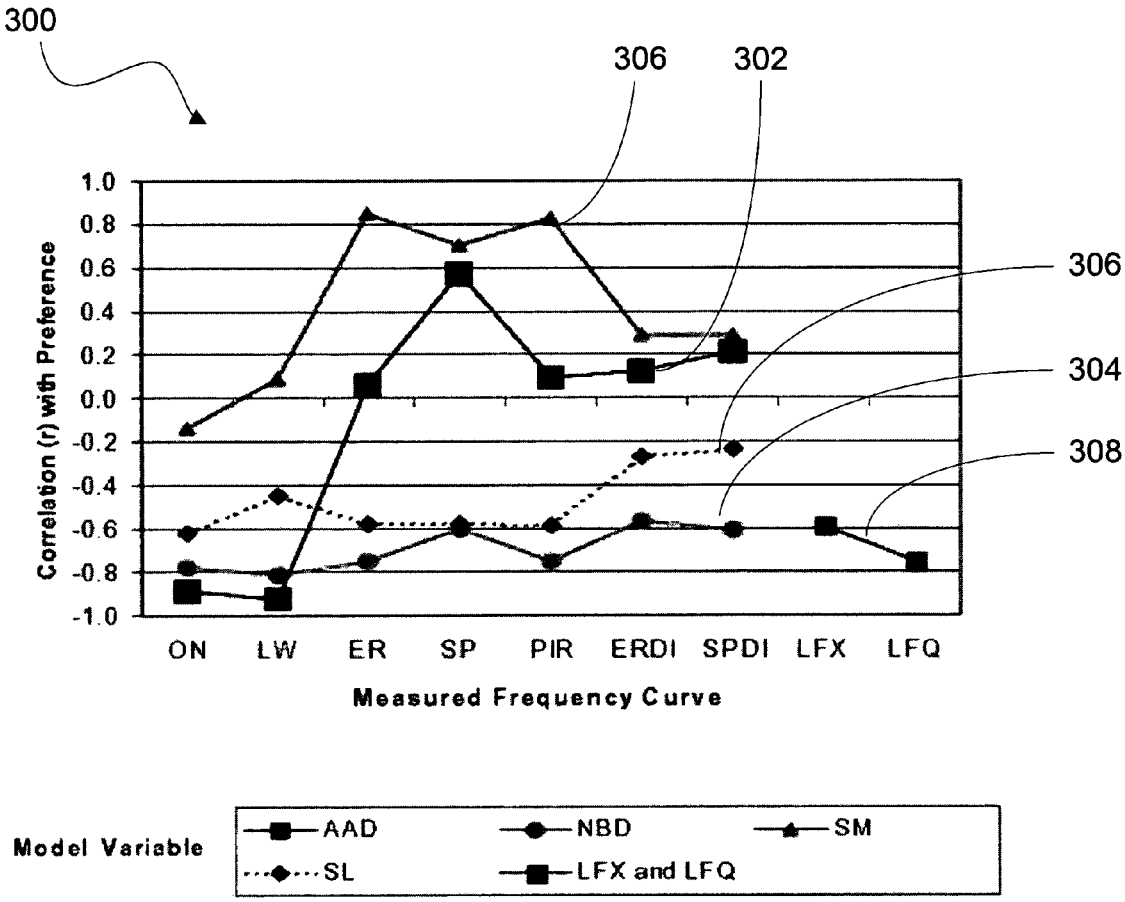
FIG. 3 illustrates the correlation (r) with preference for each of six independent variables applied to the frequency curves shown in FIG. 2.
Figure 5:
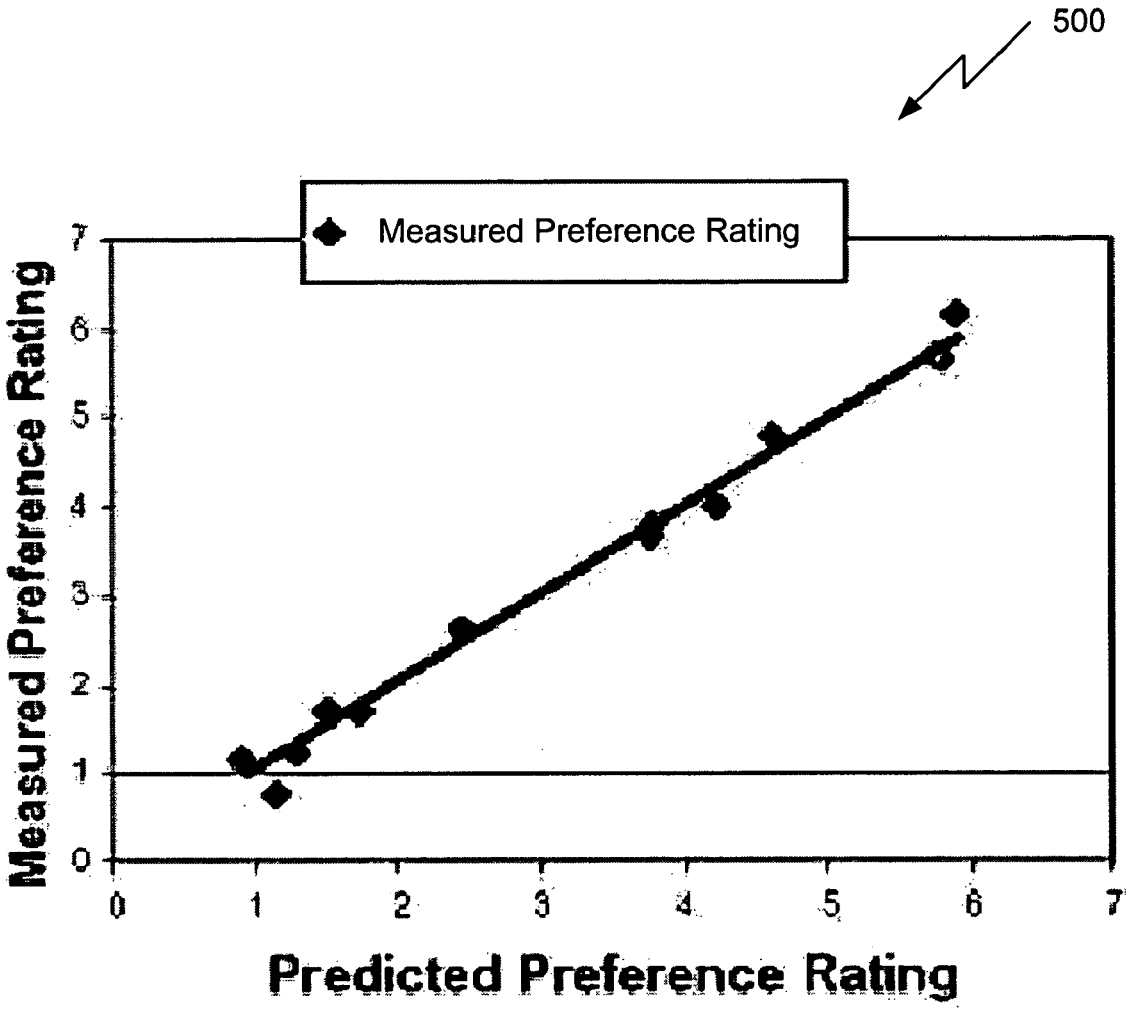
FIG. 5 is a plot of the measured versus predicted preference ratings from the test of thirteen different loudspeakers based on an anechoic model developed according to an example implementation described below.

By way of example, FIG. 5 illustrates the correlation (r) with preference for each of the six independent variables applied to the frequency curves shown in FIG. 3 for a sample of thirteen loudspeakers for which both objective and subjective measurement were taken. The predictive power of each independent variable can be determined by calculating its partial correlation with preference rating for each of the seven frequency curves.

If the premise of the preference model is well-founded, all independent variables (except smoothness) should produce negative correlations with preference since larger variable values represent larger deviations from an ideal frequency response. Smoothness (SM), on the other hand, should produce positive correlations since larger values of SM indicate increased smoothness in the frequency response. These assumptions are all true for the variables NBD, LFX and LFQ, where higher values correspond to lower preference ratings. For the other variables (AAD, SL and SM), the expected magnitude and sign of the correlation vary significantly depending on which curve the metric is applied. AAD shows the expected strong negative correlation when it is applied to the on-axis and listening window curves (i.e., a flat response produces higher preference ratings). But when applied to other measurements (ER, PIR and the two directivity indices), AAD has a weak correlation with preference. When applied to sound power, AAD shows a relatively strong but positive correlation (r=0.6), which indicates that as the sound power response becomes flatter it actually produces lower preference ratings, indicating that smoothness may be a good metric for assessing the quality of the sound power.

Variables that have small correlations with preference are smoothness (SM) and slope (SL) when applied to the ON and LW curves, and AAD when applied to ER and PIR. The two directivity indices generally yield poor correlations regardless of which metric is applied, with the exception of NBD. In fact, the narrow band deviation (NBD) metric yields some of the highest correlations with preference, independent of the frequency curve to which it is applied.

In addition to correlating the independent variables with preference, it may be useful to select those independent variables that are highly correlated to the predicted variable (i.e., preference rating) but that are relatively uncorrelated with each other. Thus, the degree to which the independent variables show multicollinearity may also be assessed. Accordingly, the multicollinearity among the independent variables considered in the model may be examined utilizing principal component analysis (PCA), by plotting the interdependence among the independent variables using a correlation circle.

Figure 4:
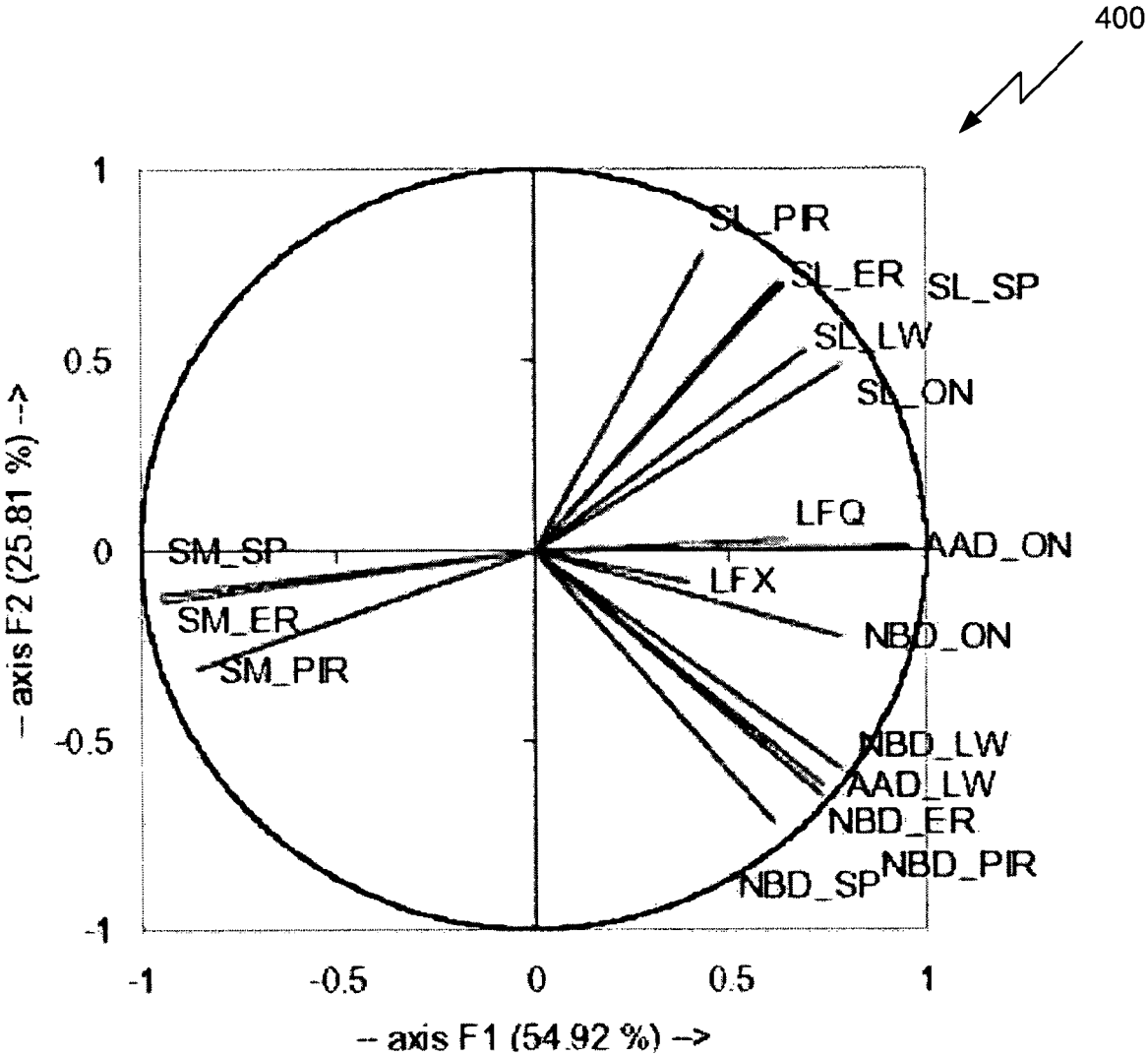
FIG. 4 is a correlation circle showing the mapping of twenty-three independent variables into two-dimensional factor space based on principle component analysis of thirteen loudspeakers as described below.

FIG. 4 is a correlation circle showing the mapping of the twenty-three independent variables into two-dimensional factor space (Factor space 1 and 2) based on PCA of the sample of loudspeakers. FIG. 4 thus shows the interdependence among the independent variables. Typically, Factors 1 and 2 account for almost 81% of the variance represented within the model independent variables of the model. Variables strongly associated with Factors 1 and 2 are located far from the center along the x-axis and y-axis, respectively. Close proximity between two variables indicates they are highly correlated with each other. Variables opposite to the center have negative correlation with each other. As expected, the metrics smoothness (SM) and narrow band deviation (NBD) are negatively correlated with each other. Slope (SL) and NBD appear also to be negatively correlated with each other and are associated with Factor 2. Variables highly associated with Factor 1 include metrics applied to the on-axis sound (AAD_ON, NBD_ON) and to a lesser extent bass extension (LFX) and quality (LFQ).

A certain degree of collinearity and redundancy exists among the variables based on their close proximity to each other. Metrics that are closely related to one another (e.g., AAD and NBD), particularly when applied to the same curve or a related curve (e.g. ER versus SP, SPDI versus ERDI), tend to produce the greatest amount of collinearity. The variables NBD_ON, AAD_ON, LFX and model metrics applied to the predicted-in room response are all desirable predictor variables because they are strongly correlated with Factors 1 and 2, but not overly correlated with each other.

B. Multiple Regression Analysis

Once the independent variables are selected, in accordance with step 102 of FIG. 1, multiple regression analysis is then performed to determine respective weights for the selected independent variables, as set forth in step 104 of FIG. 1. As a general matter, regression analysis is used to predict the value of a single dependent variable using one (simple regression) or more (multiple regression) independent variables. Multiple regression assumes that the dependent variable, and usually the independent variables as well, are both metric. Metric variables are measured on interval-ratio scales as opposed to nominal categories. When the data are non-metric, or involve more than one dependent variable, other multivariate techniques such as canonical correlation, multiple discriminate analysis and conjoint analysis may be more appropriate alternatives.

In multiple regression analysis, each independent variable is weighted to maximize is ability to predict the value of the dependent variable. The respective weights of the independent variables denote the relative contribution and influence of each factor on the value of the outcome variable. As set forth above, the set of weighted independent variables is known as the regression variant and may define the model expressed below:

$$Y_1=b_0+b_1X_1+b_2X_2+b_3X_3+\ldots b_nX_n \quad (1)$$

where $Y_1$ is the predicted dependent variable, $X_1$-$X_n$ are different independent variables and $b_1$-$b_n$ are the respective weights or coefficients for the independent variables. The term $b_0$ is a constant known as the y-intercept.

Finally, regression is a linear technique with four underlying assumptions that should be met: (i) linearity in the relationship between the dependent and independent variables, (ii) constant variance of the error terms (residuals), (iii) normality of the error term distribution, and (vi) independence of the error terms. Statistical tests and examination of the standardized residual plots can determine whether the assumptions have been met.

Approaches for estimating the regression variant include confirmatory and sequential searches. Sequential searches include step-wise and forward-backward elimination where various independent variables are added or deleted to the model until some criterion is met. Combinatorial approaches test all possible subsets of variables. For models that have a large number of potential variables, the number of subsets can grow significantly (e.g., 10 variables=$2^{10}$ or 1024 possible combinations). Additionally, an algorithm known by those skilled in the art as "Leaps and Bounds" may be used as a compromise between all subsets and forward-backward stepwise regression.

Multiple regression analysis of the independent variables may be performed using a program that calculates all possible models to determine the best one for a given number of variables (by way of example, 2-6 variables). According to one another example implementation, four independent variables $X_1$-$X_4$ may be selected. The independent variable $X_1$ is a value for narrow band deviation (NBD) applied to the on-axis frequency response curve (ON), $X_2$ is a value for narrow band deviation (NBD) applied to a predicted in-room frequency response curve (PIR), $X_3$ is a value for low frequency extension (LFX), and $X_4$ is a value for smoothness (SM) applied to the predicted in-room frequency response curve (PIR). The y-intercept for the linear relation may be $b_0$=12.69. The respective weights $b_1$-$b_n$ for these independent variables may be $b_1$=−2.49, $b_2$=−2.99, $b_3$=−4.31, and $b_4$=2.32. This model may be represented by Equation (9):

$$\text{Pref. Rating}=12.69-2.49*\text{NBD_ON}-2.99*\text{NBD_PIR}-4.31*\text{LFX}+2.32*\text{SM_PIR}$$

According to another example implementation, five independent variables $X_1$-$X_5$ may be selected. The independent variable $X_1$ is a value for absolute average deviation (AAD) applied to the on-axis frequency response curve (ON), $X_2$ is a value for low frequency extension (LFX), $X_3$ is a value for low frequency quality (LFQ), $X_4$ is a value for smoothness (SM) applied to the on-axis frequency response curve (ON), and $X_5$ is a value for smoothness (SM) applied to a sound power frequency response curve (SP). The y-intercept for the linear relation may be $b_0$=6.04. The respective weights $b_1$-$b_n$ for these independent variables may be $b_1$=−0.67, $b_2$=−1.28, $b_3$=−0.66, $b_4$=4.02, and $b_5$=3.58. The models equation is represented by Equation 10:

$$\text{Pref. Rating}=6.04-0.67*\text{AAD_ON}-1.28*\text{LFX}-0.66*\text{LFQ}+4.02*\text{SM_ON}+3.58*\text{SM_SP}$$

C. Validating Preference Ratings

The final step in developing a regression model is to validate the results. The accuracy of the model is based on how well the predicted values fit to or correlate with the observed values. The results may be generalized to the population (of loudspeakers) and not specific to the sample used for estimation. The statistic commonly used to validate the results is Pearson's correlation coefficient (r) and its related coefficient of determination ($r^2$). The latter represents the percentage of variance in the dependent variable accounted for by the model. The adjusted r value takes into account the sample size and number of independent variables in the model and adjusts it accordingly. Mallow's $C_p$ criterion is a statistic particularly useful for all subsets since it automatically accounts for the number of independent variables and prevents selection of a model that is over-fitted. An acceptable $C_p$ value is equal to or lower than the number of independent variables in the model. A common problem with regression models is that the models are over-fitted and are not very generalizable to other samples. This can happen when the ratio of observations to number of independent variables falls below 5:1. Ideally, there should be fifteen to twenty observations for each independent variable. Another common problem occurs with models that have high multicollinearity among two or more variables. As the correlation between two variables increases above r=0.3, there is a limit in the ability of each variable to explain and represent the unique effects on the dependent variable. As the correlation between two variables approaches r=0.8 or higher, the sign of the coefficient can become reversed. An extreme case known as a singularity occurs where the correlation between two variables is 1, which prevents the estimate of any coefficients.

The most direct approach to validation is to obtain another sample from the population and determine the correspondence in results between the two samples. In the absence of a new sample, other approaches are possible.

FIG. 5 illustrates a plot of the measured versus predicted preference ratings from based on the anechoic model described by Equation 10. FIG. 5 shows that the measured values closely fit the predicted values from the model. The model accounts for 99% of the variance in the observed preference ratings. The adjusted-r value (0.96) is also high. The Mallow's $C_P$ value is 4, indicating that the model is not too over-fitted for the number of variables used. The RMS error of the predicted rating is very small, 0.26 preference rating. An ANOVA test indicated a very small probability that the model's variables could produce the predicted results due to chance ($F=137.34$, $p<0.0001$).

The coefficients in the model as described in Equation 10 all have the expected sign according the premise of the model. All variables, except smoothness (SM), have negative coefficients indicating that smaller deviations in amplitude response produce an increase in preference ratings. The two variables defined by smoothness both have positive signs, indicating that higher values of smoothness produce large values of preference. All of the underlying assumptions of the model have been met.

The relative contribution each variable has in predicting loudspeaker preference will now be considered. Utilizing the standardized coefficients for each variable in the model, the percentage each variable contributes in predicting the preference rating of the loudspeaker was calculated. The results are presented in TABLE 13 below. The variables related to the smoothness (SM) and average absolute deviation (AAD) of the on-axis curve have a combined weighting of approximately 45% in the model. This indicates that the flatness and smoothness of the direct sound is an important factor in predicting sound quality. The next largest contributor is the smoothness of the sound power (SM_SP) weighted at approximately 30%. The remaining two variables related to low frequency deviations contribute a combined 25% (approximately) to the model (LFQ=19%, LFX=6%, approximately). Finally, the standardized residuals were examined and found to be normally distributed with constant and independent variance.

TABLE 13

| Model Variable | Proportional Contribution in Model (%) |
|---|---|
| AAD_ON | 18.64 |
| LFX | 6.27 |
| LFQ | 18.64 |
| SM_SP | 30.12 |
| SM_ON | 26.34 |
| TOTAL | 100.00 |

To test the generalizability of the model, the model was applied to an additional set of fifty-seven loudspeakers evaluated in eighteen different tests. Subsequently, this sample was combined with the thirteen speakers from Test One to develop a generalized model based on seventy loudspeakers.

The anechoic model described above in equation 10 when applied to a new larger loudspeaker sample produced a correlation of 0.70 between the predicted and measured preference ratings. The lower correlation was likely related to the model being too tightly fitted to the small sample (thirteen loudspeakers) and/or the loss of precision from combining subjective data from eighteen unrelated tests. A more generalized model may be necessary to accurately predict the ratings for a large sample of speakers.

Figure 6:
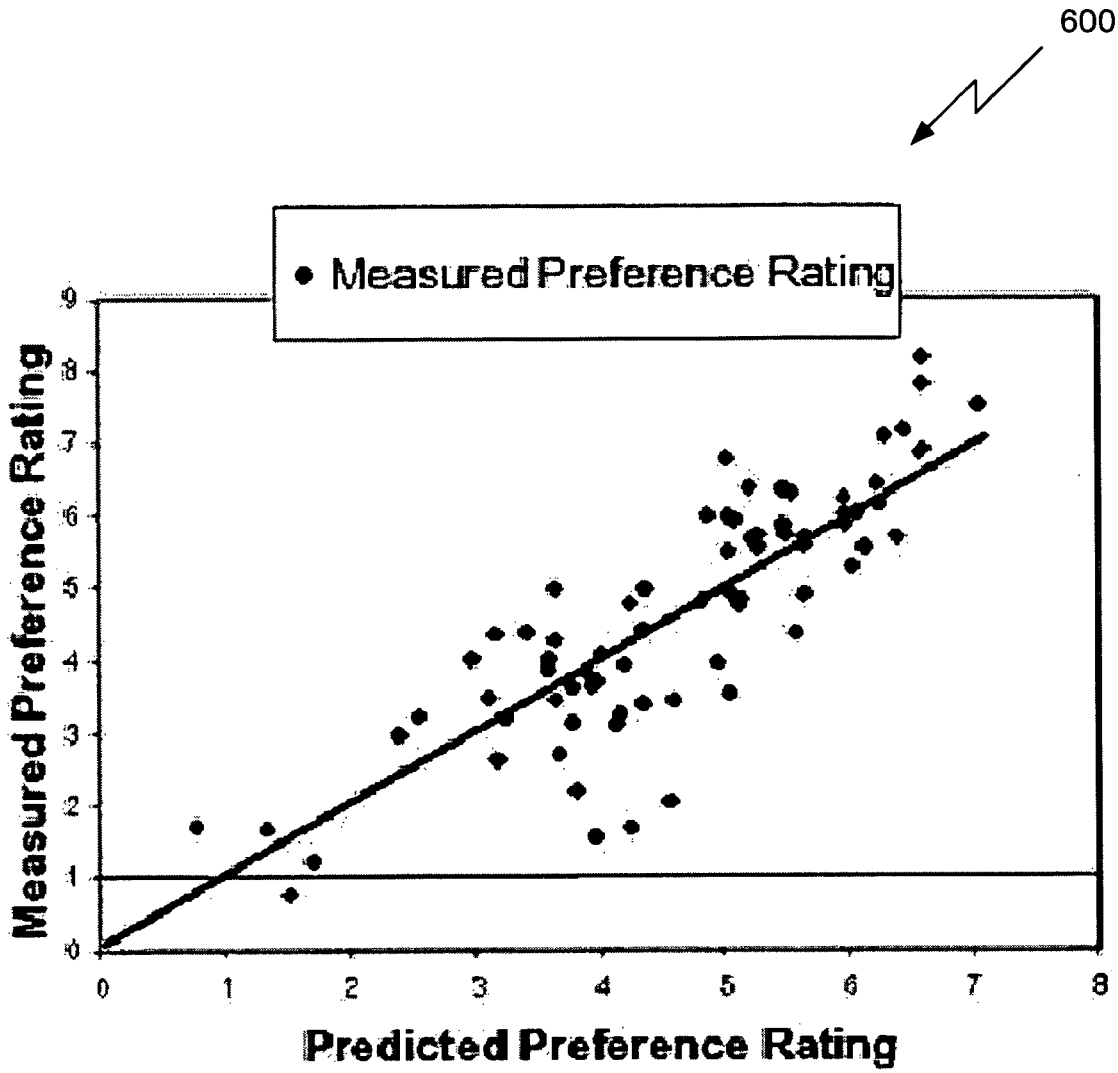
FIG. 6 is a plot of the measured versus predicted preference ratings based on a generalized anechoic model developed according to an example implementation described below.

FIG. 6 is a plot of the measured versus predicted preference ratings based on the more generalized anechoic model described by Equation 9 above. An ANOVA test indicated a very small probability that the model's variables could predict the ratings due to chance alone; $F(4,79)=54.88$, $p<0.0001$). The residual error from the model is 0.8 preference ratings. Examination of the residuals showed them to be normally distributed with constant and independent variance.

TABLE 14 below set forth the proportional weighting of each independent variable in the generalized model described by Equation 11 above. The standardized coefficients were used to determine the proportional contribution of each variable towards predicting preference. The mean narrow band deviations in the on-axis curve contribute a significant amount (31.5%) to the predicted preference rating. The narrow band deviation (NBD) and smoothness (SM) of the predicted in-room response (PIR) contributes a combined 38%, with low frequency extension contributing 30.5%, as set forth in TABLE 14 below.

| Model Variable | Proportional Weight in Model (%) |
|---|---|
| NBD_PIR | 20.5 |
| NBD_ON | 31.5 |
| LFX | 30.5 |
| SM_PIR | 17.5 |
| TOTAL | 100.0 |

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A method for predicting a loudspeaker preference rating, the method including, measuring the frequency response of a loudspeaker by sending a series of audio signals to the loudspeaker;

recording in a storage medium the measured frequency response of the loudspeaker for each audio signal; and predicting the loudspeaker's preference rating, using a multiple linear statistical regression model, based upon a measured deviation in the stored measured frequency response of the loudspeaker.

2. The method of claim 1 where the measured frequency response is calculated from measurements having at least $1/6^{th}$ octave smoothing.

3. The method of claim 1 where the measured deviation is the mean amplitude deviation in a frequency response.

4. The method of claim 1 where the measured frequency response is calculated from measurements having a $1/20^{th}$ octave smoothing filter.

5. The method of claim 1 where the measured frequency response is calculated from anechoic measurements.

6. The method of claim 1 where the measured frequency response is calculated from in-room measurements.

7. A method for predicting a loudspeaker preference rating, the method including, measuring a frequency response of a loudspeaker by sending a series of audio signals to the loudspeaker;

recording in a storage medium the measured frequency response of the loudspeaker for each audio signal; and predicting the loudspeaker's preference rating, using a statistical regression model, based upon a measured deviation in the stored frequency response of the loudspeaker, where the statistical regression model uses weighted independent variables arranged in a linear relationship to calculate the loudspeaker preference rating and where the independent variables are derived from applying different statistical measures to frequency response curves that are derived from objective measurements.

8. The method of claim 7 where the statistical measures are selected from the group consisting of measures predictive of direct sound as perceived by a listener, measures predictive of early-reflected sound as perceived by a listener, measures predictive of reverberant sound as perceived by a listener, and combinations of these.

9. The method of claim 7 where the frequency response curves are selected from the group consisting of on-axis response, listening window, early-reflections, predicted in-room response, sound power, early-reflections directivity index and sound power directivity index and combinations of these.

10. A method for predicting a loudspeaker preference rating, the method comprising:

generating a comprehensive set of frequency response curves with a computer for a set of loudspeakers calculated using an octave smoothing filter at least as high as $1/6^{th}$ octaves;

applying different statistical measures to the set of frequency response curves to derive a set of independent variables;

correlating independent variables to a loudspeaker preference rating by calculating with the computer a measured deviation between the statistical measures and frequency response for each variable;

selecting a set of independent variables indicative of the loudspeaker preference rating determined by selecting independent variables with maximum ability to predict a loudspeaker preference rating;

applying a statistical regression technique to the selected set of independent variables to predict the loudspeaker preference rating by using a statistical regression technique to weight the variables and arrange the weighted independent variables into a linear relationship on which the loudspeaker preference variable depends.

11. A method of claim 10, where selecting the set of independent variables with the maximum ability to predict the loudspeaker preference rating is accomplished by determining which statistical measure of an independent variable has the least deviation in mean amplitude when applied to the selected frequency response.

12. A method for predicting a loudspeaker preference rating based on objective measurements, the method comprising:

generating objective measurements by applying a plurality of statistical measures to a set of frequency response curves to derive candidate independent variables;

from a plurality of the candidate independent variables indicative of loudspeaker sound quality, selecting with a computer a set of independent variables $X_1$-$X_n$ determined as maximizing the ability of a loudspeaker preference variable $Y_1$ to predict a loudspeaker preference rating;

performing a multiple regression analysis to determine respective weights $b_1$-$b_n$ for the selected independent variables $X_1$-$X_n$; and arranging the weighted independent variables into a linear relationship on which a loudspeaker preference variable $Y_1$ depends according to:

$$Y_1=b_0+b_1X_1+b_2X_2+b_3X_3+\ldots b_nX_n,$$

where n is the number of selected independent variables; and predicting the loudspeaker preference rating by solving the linear relationship.

13. The method according to claim 12 where n ranges from 2-6.

14. The method according to claim 12 where n=5.

15. The method according to claim 12 where n=5, $X_1$ is a value for absolute average deviation applied to an on-axis frequency response curve, $X_2$ is a value for low frequency extension, $X_3$ is a value for low frequency quality, $X_4$ is a value for smoothness applied to the on-axis frequency response curve, and $X_5$ is a value for smoothness applied to a sound power frequency response curve.

16. The method according to claim 12 where $b_0$=6.04, $b_1$=−0.67, $b_2$=−1.28, $b_3$=−0.66, $b_4$=4.02, and $b_5$=3.58.

17. The method according to claim 12 where n=4, $X_1$ is a value for narrow band deviation applied to an on-axis frequency response curve, $X_2$ is a value for narrow band deviation applied to a predicted in-room frequency response curve, $X_3$ is a value for low frequency extension, and $X_4$ is a value for smoothness applied to the predicted in-room frequency response curve.

18. The method according to claim 12 where $b_0$=12.69, $b_1$=−2.49, $b_2$=−2.99, $b_3$=−4.31, and $b_4$=2.32.

19. A method for predicting a loudspeaker preference rating based on objective measurements, comprising:

generating objective measurements by determining respective values utilizing a computer for a set of independent variables, the independent variables including absolute average deviation applied to an on-axis frequency response curve ($ADD_{ON}$), low frequency extension (LFX), low frequency quality (LFQ), smoothness applied to the on-axis frequency response curve ($SM_{ON}$), and smoothness applied to a sound power frequency response curve ($SM_{SP}$);

performing a multiple regression analysis utilizing the computer to determine respective weights $b_1$-$b_n$ for the selected independent variables; and predicting a loudspeaker preference rating by finding a value for a loudspeaker preference variable (Pref. Rating) indicative of the loudspeaker preference rating according to:

$$\text{Pref. Rating}=b_0+b_1*ADD_{ON}+b_2*LFX+b_3*LFQ+b_4*SM_{ON}+b_5*SM_{SP}.$$

20. The method according to claim 19 where $b_0$=6.04, $b_1$=−0.67, $b_2$=−1.28, $b_3$=−0.66, $b_4$=4.02, and $b_5$=3.58.

* * * * *